US007632148B1

(12) United States Patent
Kawamura et al.

(10) Patent No.: US 7,632,148 B1
(45) Date of Patent: Dec. 15, 2009

(54) SEALED AND GROUNDED ELECTRICAL CONNECTOR AND SEALED AND GROUNDED ELECTRICAL CONNECTOR ASSEMBLY

(75) Inventors: Makiko Kawamura, Ann Arbor, MI (US); Ping Chen, West Bloomfield Hills, MI (US)

(73) Assignee: J.S.T. Corporation, Farmington Hill, MI (US)

( * ) Notice: Subject to any disclaimer, the term of this patent is extended or adjusted under 35 U.S.C. 154(b) by 0 days.

(21) Appl. No.: 12/372,937

(22) Filed: Feb. 18, 2009

(51) Int. Cl.
*H01R 13/648* (2006.01)

(52) U.S. Cl. ..... 439/607.41; 439/98

(58) Field of Classification Search ..... 439/98, 439/108, 607.41–607.52
See application file for complete search history.

(56) References Cited

U.S. PATENT DOCUMENTS 6,053,780 A 4/2000 Ono et al.
6,575,784 B1 6/2003 Yamada
6,739,888 B2 5/2004 Kato et al.
6,896,549 B2 * 5/2005 Feuerreiter et al. ..... 439/585
7,048,586 B2 5/2006 Ishizaki et al.
7,165,995 B2 1/2007 Fukushima et al.
7,300,309 B2 * 11/2007 Montena ..... 439/578
7,442,099 B2 * 10/2008 Egawa et al. ..... 439/883

* cited by examiner

*Primary Examiner*—Khiem Nguyen
(74) *Attorney, Agent, or Firm*—Rader, Fishman & Grauer, PLLC

(57) ABSTRACT

An electrical connector includes a shield cover forming a shield cover cavity that receives a grounding assembly and a terminal mounting block. A conduit is integrally connected to the shield cover and receives at least one cable assembly therethrough for connection to the terminal mounting block. The grounding assembly disposed between the conduit and terminal mounting block clamps an exposed wire shielding portion of the at least one cable assembly for electrically grounding the same upon fastening the electrical connector to an electrically-conductive support surface. An O-ring-like cable seal seals the at least one cable assembly in the conduit. An O-ring-like shield cover seal extends externally of and circumferentially about the shield cover to seal the electrical connector when the electrical connector is received in a barrier wall recess formed by a barrier wall structure. The electrical connector and the barrier wall structure form an electrical connector assembly.

34 Claims, 15 Drawing Sheets

SEALED AND GROUNDED ELECTRICAL CONNECTOR AND SEALED AND GROUNDED ELECTRICAL CONNECTOR ASSEMBLY

FIELD OF THE INVENTION

The present invention relates to an electrical connector. More particularly, the present invention is directed to a sealed and grounded electrical connector.

BACKGROUND OF THE INVENTION

Electrical connectors are well known in the prior art. One such electrical connector is disclosed in U.S. Pat. No. 7,048,586 to Ishizaki et al. that discloses a shield connector. The shield connector includes a conductive connector housing, a shielded wire extended from the connector housing and a conductive shielding terminal. The shielded wire includes a conductor electrically connected to a mating terminal, an insulative sheath covering the conductor and a conductive shielding member covering the sheath. The conductive shielding terminal includes a first plate, a conductive second plate and a plurality of fixing members. The first plate is disposed on the connector housing and has a first through hole through which the shielded wire passes and a contact portion which is in contact with the shielding member. The conductive second plate has a second through hole through which the shielded wire passes. The plurality of fixing members fixes the first plate and the second plate on the connector housing such that the first plate is pressed by the second plate against the connector housing.

Another electrical connector known in the prior art is discussed in U.S. Pat. No. 7,165,995 to Fukushima et al. which discloses an electromagnetic interference shielded connector. The electromagnetic interference shielded connector includes a plurality of electric wires, a connector housing and a metallic shielding shell. The plurality of electric wires has connecting parts at the respective ends of the electric wires. The connector housing contains the electric wires and the connecting parts. The metallic shielding shell includes a cylindrical electric-wire drawn-out portion and a terminal drawn-out portion. The electric wires are drawn out through cylindrical electric-wire drawn-out portion. The connecting parts are protruded from the terminal drawn-out portion. The connector housing is formed by an entire molding so as to fill a resin inside of the metallic shielding shell in a state that the electric wires are inserted through the electric-wire drawn-out portion and the connecting parts are drawn out through the terminal drawn-out portion.

These prior art connectors are not conducive for high voltage or high current applications. Also, these prior art connectors do not accept blade-type male terminals.

SUMMARY OF THE INVENTION

Accordingly, an electrical connector of the present invention is hereinafter described and includes a shield cover, at least one cable assembly, a conduit, a grounding assembly, a shield cover seal, a fastener structure and a terminal mounting block. The shield cover has a base panel and four side walls serially connected to each other and connected to and depending from the base panel to define a shield cover cavity into the shield cover. The base panel has a base panel hole formed therethrough. The connected four side walls define a peripheral side wall edge portion forming an opening into the shield cover cavity. The at least one cable assembly includes a cable, a back cover, a cable seal and a cable assembly terminal. The cable has a conducting wire with an exposed conducting wire portion, an insulating sheath surrounding the conducting wire and having an exposed insulating sheath portion, a wire shielding surrounding the insulating sheath and having an exposed wire shielding arrangement including an exposed wire shielding portion and an outer insulating jacket surrounding the wire shielding. The back cover is in contact with and surrounds the insulating sheath.

The cable assembly terminal is connected to the exposed conducting wire portion. The cable seal surrounds the outer insulating jacket and is in sealing contact with the conduit and the outer insulating jacket. The conduit is connected to a selected one of the four side walls and forms a conduit passageway therethrough. The conduit passageway is in communication with the shield cover cavity. The conduit is sized to receive a portion of the at least one cable assembly therein and therethrough and the conduit is adapted for the back cover to be releasably connected thereto. The grounding assembly is sized to be received and releasably retained in the shield cover cavity between the terminal mounting block and the conduit passageway. The shield cover seal is in contact with and extends about the connected four side walls adjacent the opening. The fastener structure has a fastener head and an elongated shaft. The elongated shaft is sized to be slidably received in the base panel hole. The terminal mounting block is disposed in the shield cover cavity and is connected to the shield cover. The terminal mounting block is adapted to receive and retain at least the cable assembly terminal and the exposed conducting wire portion therein and to permit the elongated shaft to pass therethrough.

Another embodiment of the invention is an electrical connector assembly that is adapted to be electrically connected a plurality of power supply terminals of a power supply and mechanically connected to a support surface having a fastener hole formed thereinto and a plurality of terminal holes formed thereinto with the power supply terminals projecting therethrough. The electrical connector assembly includes the electrical connector as described above and a barrier wall structure. The barrier wall structure has a barrier wall that is connected to and projects from the support surface to define a barrier wall recess. The barrier wall extends circumferentially about the plurality of power supply terminals, the support surface fastener hole and the plurality of support surface terminal holes. The barrier wall is configured to receive therein the peripheral side wall edge portion of the shield cover along with the shield cover seal. When the peripheral side wall edge portion and the shield cover seal are received in the barrier wall recess, the plurality of power supply terminals and the cable assembly terminals are matably engaged with each other, the shield cover seal is in pressing contact with the barrier wall and the fastener structure is aligned for threadable engagement with the support surface fastener hole.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
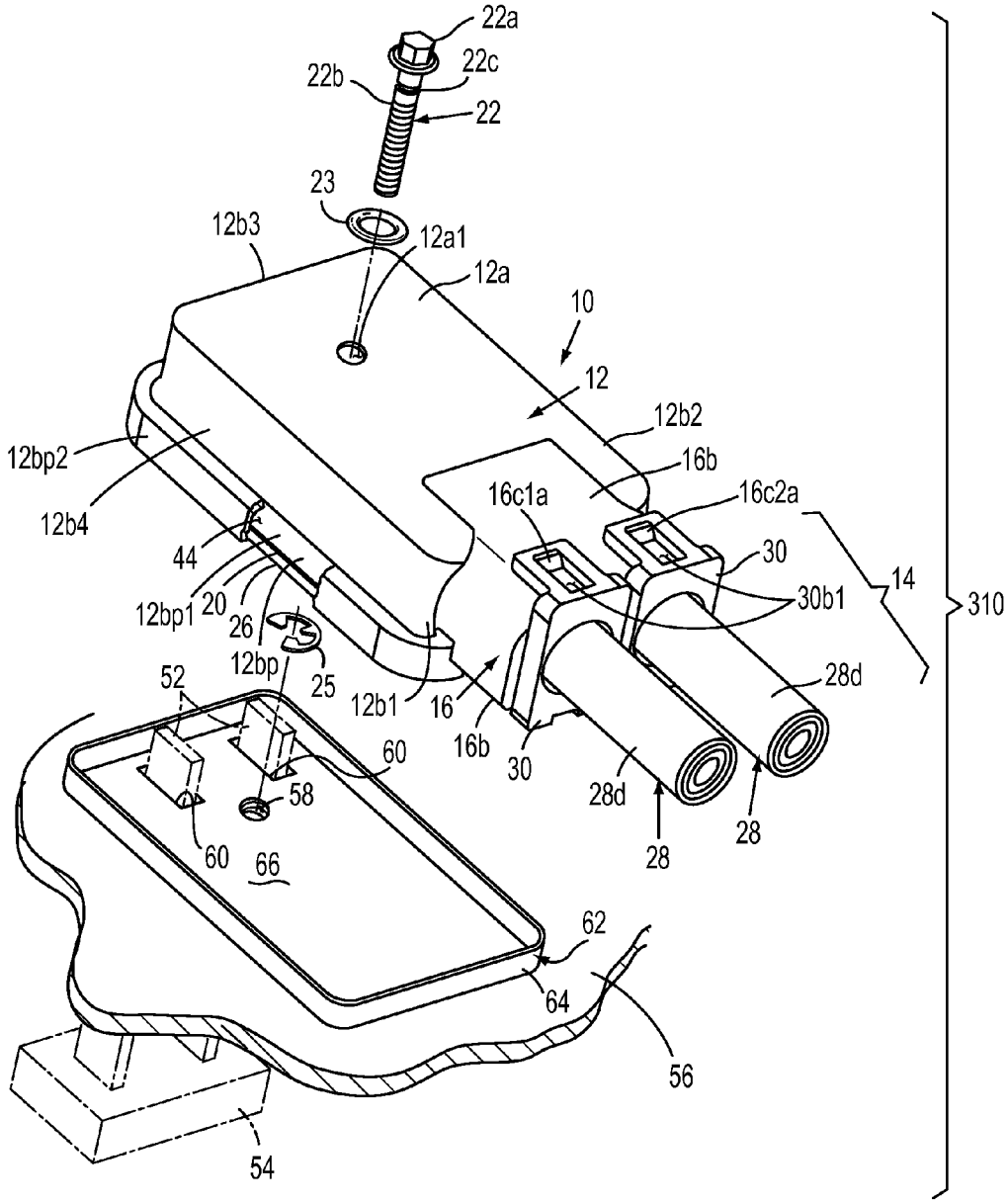
FIG. 1 is a perspective view, partially exploded and partially broken away, of a first exemplary embodiment of an electrical connector of the present invention disposed apart and disconnected from a plurality to power supply terminals projecting through a support surface and electrically disconnected to a power supply.

Hereinafter, embodiments of the present invention will be described with reference to the attached drawings. The structural components common to those of the prior art and the structural components common to respective embodiments of the present invention will be represented by the same symbols and repeated description thereof will be omitted.

A first exemplary embodiment of an electrical connector 10 of the present invention is hereinafter described with reference to FIGS. 1-11. As generally shown in FIGS. 1-3, the electrical connector 10 includes a shield cover 12, a plurality of cable assemblies 14, a conduit 16, a grounding assembly 18, a shield cover seal 20, a fastener structure 22 and terminal mounting block 24.

In FIGS. 1, 2, 4 and 6, the shield cover 12 has a base panel 12*a* and four side walls 12*b*1-12*b*4 that are serially connected to each other and are connected to and depend from the base panel 12*a* to define a shield cover cavity 12*c* (FIG. 2) into the shield cover 12. In FIG. 1, the base panel 12*a* has a base panel hole 12*a*1 formed therethrough. The connected four side walls 12*b*1-12*b*4 define a peripheral side wall edge portion 12*bp* forming an opening 26 into the shield cover cavity 12*c*. Although not by way of limitation but by example only, the shield cover 12 for the first exemplary embodiment of the present invention is fabricated from an electrically conductive material such as copper, steel, zinc or aluminum.

Figure 6:
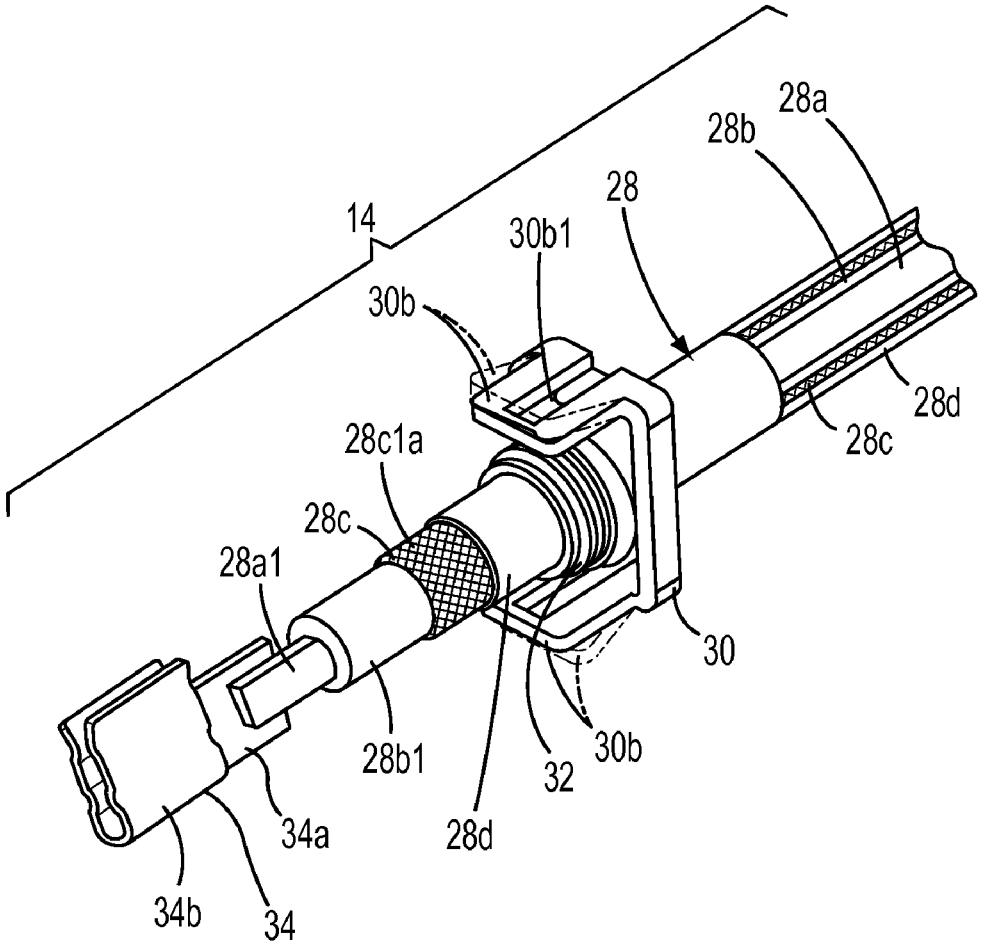
FIG. 6 is an enlarged perspective view of a cable assembly as a component of the first exemplary embodiment of the electrical connector of the present invention.

Although the description of the first exemplary embodiment of the invention describes a plurality of cable assemblies 12, one of ordinary skill in the art would appreciate that at least one cable assembly 12 is necessary to practice the present invention. As best shown in FIGS. 3 and 6, each cable assembly 12 includes a cable 28, a back cover 30, a cable seal 32 and a cable assembly terminal 34. The cable seal 32 forms a seal between the conduit 16 and the cable 28. The cable 28 has a conducting wire 28*a* with an exposed conducting wire portion 28*a*1, an insulating sheath 28*b* surrounding the conducting wire 28*a* and having an exposed insulating sheath portion 28*b*1, a wire shielding 28*c* surrounding the insulating sheath 28*b* and having an exposed wire shielding arrangement 28*c* (discussed in more detail below with regard to the second exemplary embodiment of the invention) including an exposed wire shielding portion 28*c*1*a* and an outer insulating jacket 28*d* surrounding the wire shielding 28*c*. In FIGS. 1, 2 and 6, the back cover 30 is in contact with and surrounds the outer insulating jacket 28*d*. As best shown in FIG. 6, the cable assembly terminal 34 connected to the exposed conducting wire portion 28*a*1 by any conventional means such as ultrasonic welding. Further, as illustrated in FIGS. 3 and 6, the cable seal 32 surrounds the outer insulating jacket 28*d* and is in sealing contact with the conduit 16 and the outer insulating jacket 28*d*.

Figure 2:
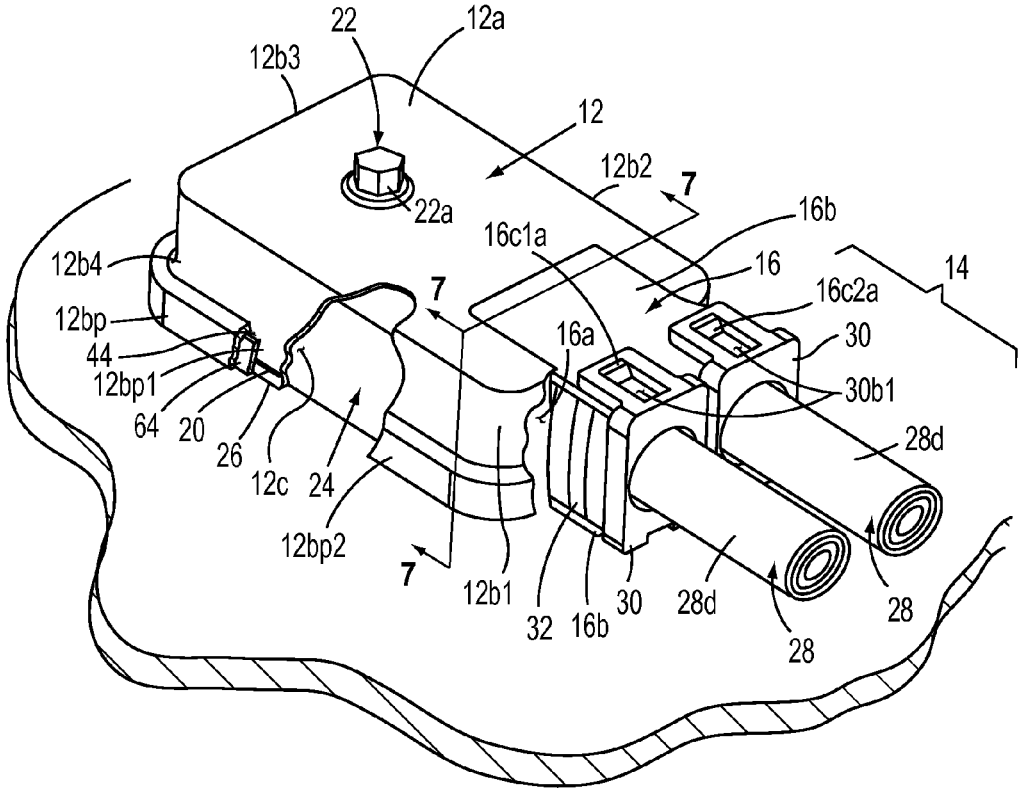
FIG. 2 is a perspective view, partially broken away, of the first exemplary embodiment of the electrical connector of the present invention electrically connected to the power supply.
Figure 3:
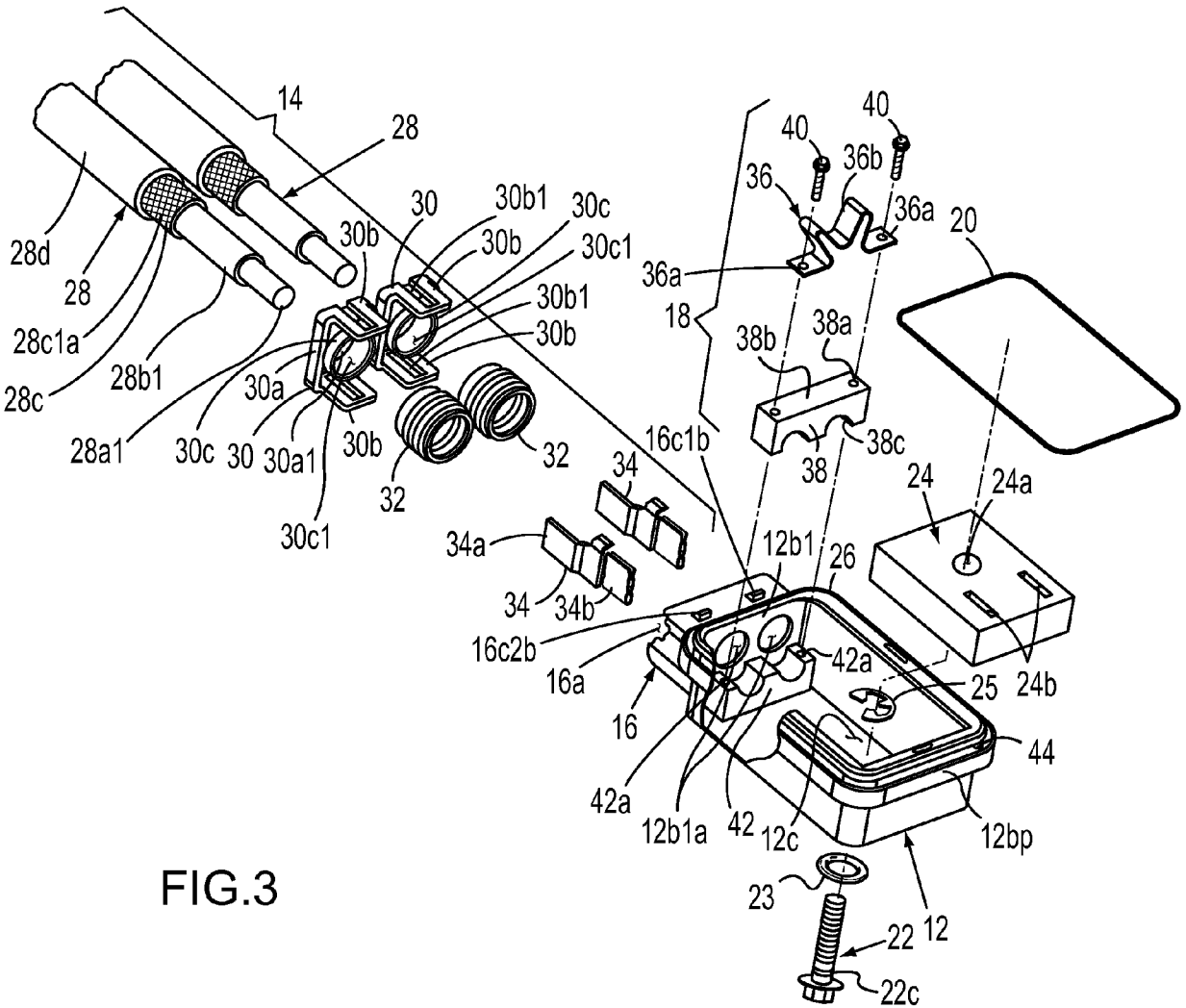
FIG. 3 is an exploded perspective view the first exemplary embodiment of the electrical connector of the present invention.
Figure 4:
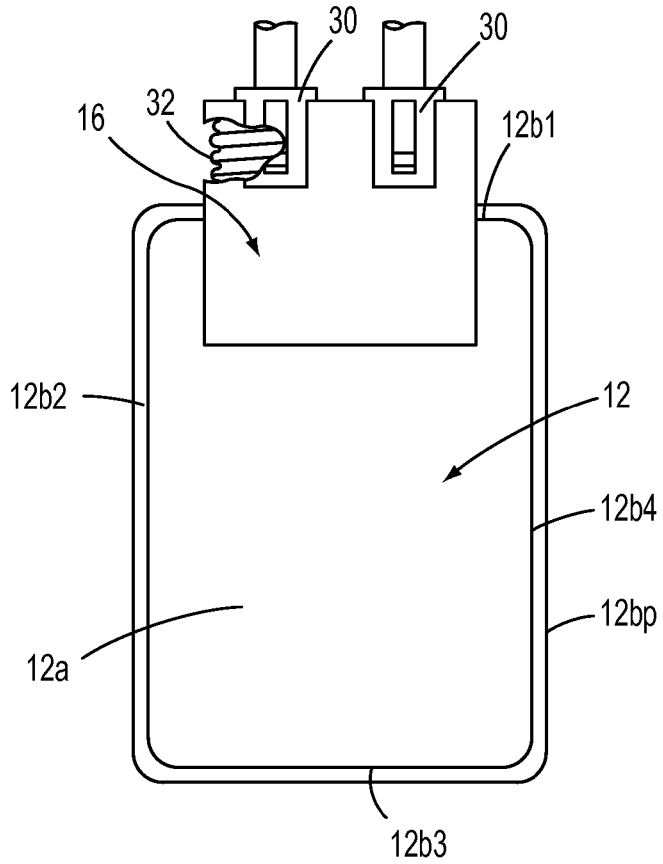
FIG. 4 is a top plan view of the first exemplary embodiment of the electrical connector of the present invention.

With reference to FIGS. 1 and 2, the conduit 16 is connected to a selected one of the four side walls 12*b*1-12*b*4. By way of example only, the conduit 16 is connected to side wall 12*b*1. As shown in FIG. 3, the conduit 16 forms a conduit passageway 16*a* therethrough. The conduit passageway 16*a* is in communication with the shield cover cavity 12*c* via a plurality of side wall holes 12*b*1*a*. As specifically shown in FIGS. 8 and 9, the conduit 16 is sized to receive a portion of the each cable assembly 14 therein and therethrough. As discussed in more detail below, the conduit 16 is adapted for the back cover 30 to be releasably connected to the conduit 16.

As reflected in FIGS. 3, 7, 10 and 11, the grounding assembly 18 is sized to be received and is releasably retained in the shield cover cavity 12*c* between the terminal mounting block 24 and the conduit passageway 16*a*. The shield cover seal 20 is in contact with and extends about the connected four side walls 12*b*1-12*b*4 and adjacent the opening 26. In FIG. 1, the fastener structure 22 has a fastener head 22*a* and an elongated shaft 22*b* formed with a retainer clip groove 22*c*. Additionally, a skilled artisan would appreciate that a shaft O-ring 23 is sized to slidably receive the shaft 22*b* to seal the shield cover 12 and that a retainer clip 25 releasably engages the shaft 22*b* by being inserted into the retainer clip groove 22*c* to retain the fastener structure 22 to the shield cover 12. The elongated shaft 22*b* is sized to be slidably received in the base panel hole 12*a*1. Further, although not by way of limitation but by example only, the terminal mounting block 24 has a terminal mounting block hole 24*a* formed therethrough that is sized to slidably receive the elongated shaft 22*b* after being slidably received by the base panel hole 12*a*1. Furthermore, the terminal mounting block 24 is a conventional one known in the art and is represented by a box-shaped structure having the terminal mounting block hole 24*a* and a pair of terminal receiving holes 24*b* formed therein. No further discussion of the conventional terminal mounting block 24 is deemed necessary for the understanding of the present invention.

Figure 9:
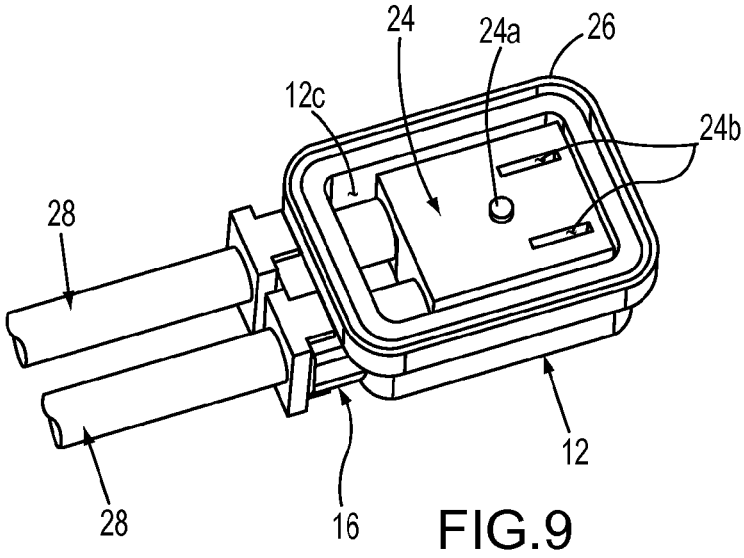
FIG. 9 is an exploded perspective view the first exemplary embodiment of the electrical connector of the present invention assembled with the components shown in FIG. 8.
Figure 10:
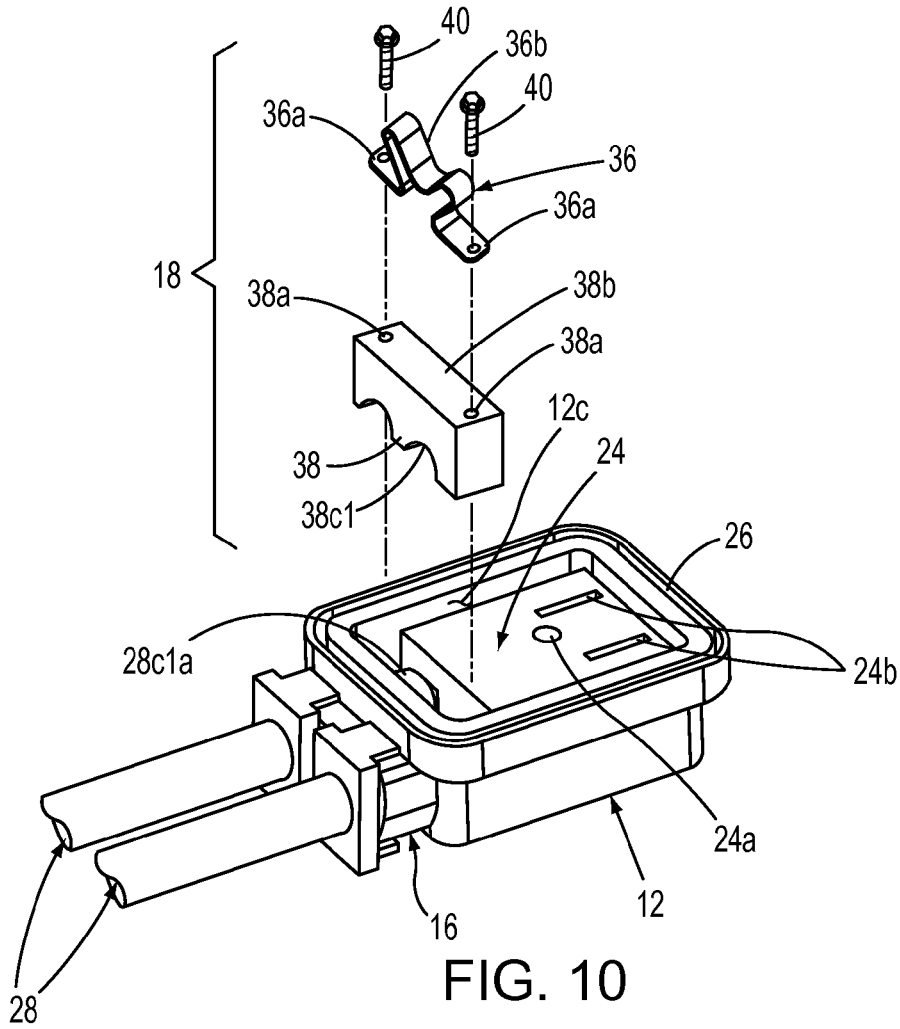
FIG. 10 is an exploded, partially-assembled perspective view the first exemplary embodiment of the electrical connector of the present invention with an exploded perspective view of a grounding assembly.
Figure 11:
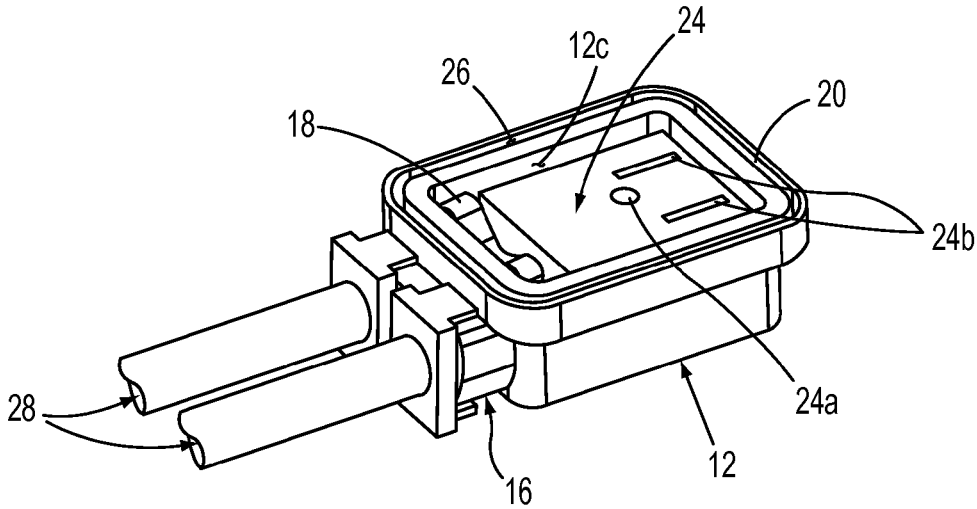
FIG. 11 is an assembled perspective view the first exemplary embodiment of the electrical connector of the present invention.

In FIGS. 9-11, the terminal mounting block 24 is disposed in the shield cover cavity 12*c* and is connected to the shield cover 12 by any conventional means such as by adhesive or fasteners. As is known in the art, the terminal mounting block 24 is adapted to receive and retain at least the cable assembly terminal 34 and the exposed conducting wire portion 28*a*1 therein and to permit the elongated shaft 22*b* to pass therethrough. As best shown in FIG. 1, upon releasably connecting the back cover 30 to the conduit 16, the cable seal 32 is received and retained in the conduit passageway 16*a* in a sealing relationship with the conduit 16 and the outer insulating jacket 28*d* (FIG. 6).

Figure 5:
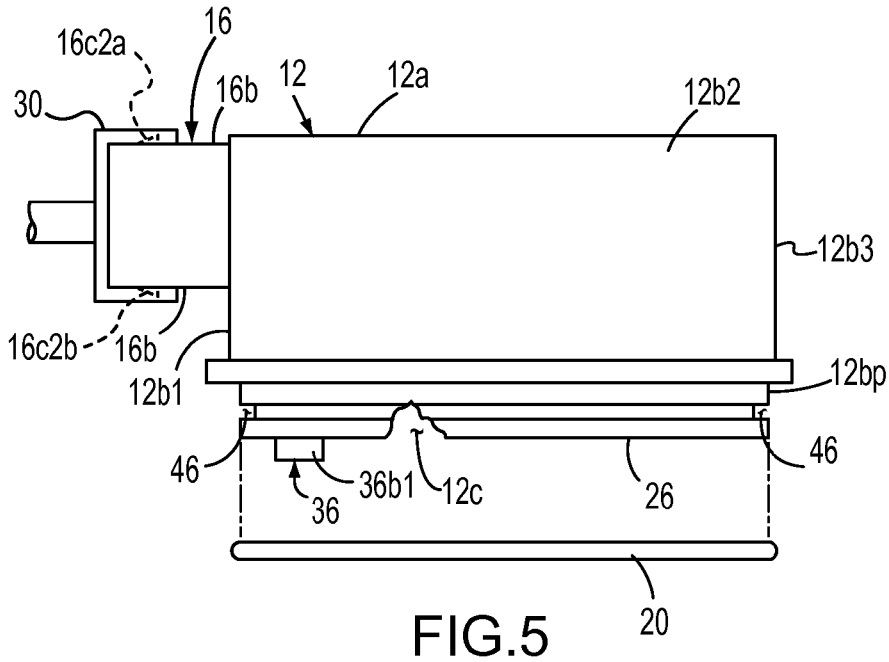
FIG. 5 is a side elevation view of the first exemplary embodiment of the electrical connector of the present invention.
Figure 7:
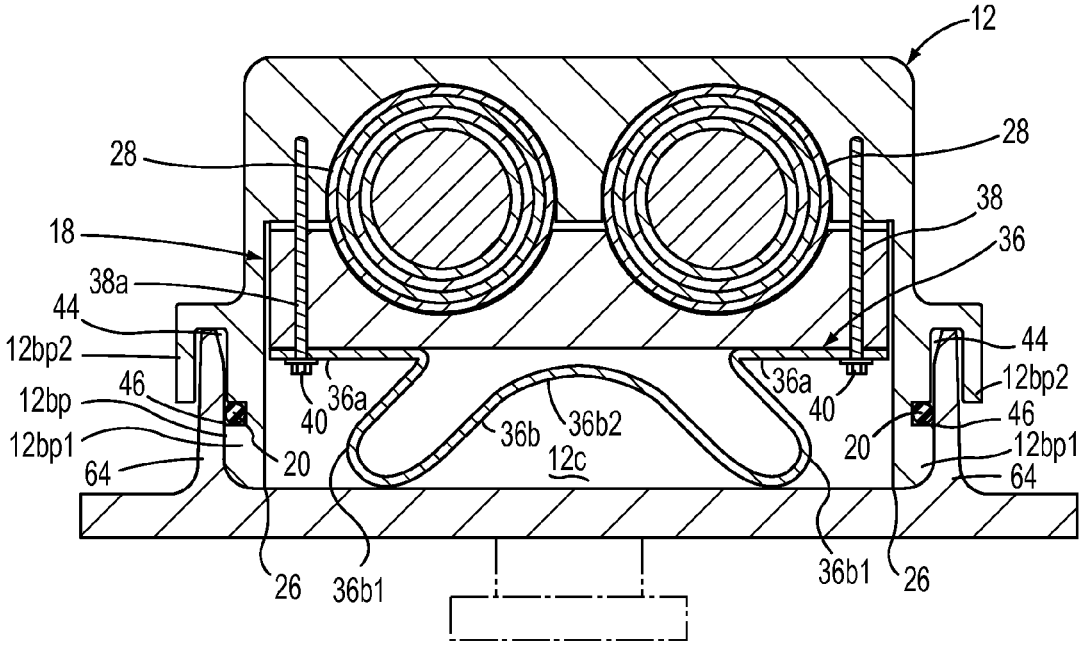
FIG. 7 is a cross-sectional view of the first exemplary embodiment of the electrical connector of the present invention taken along line 7-7-7 in FIG. 2.
Figure 8:
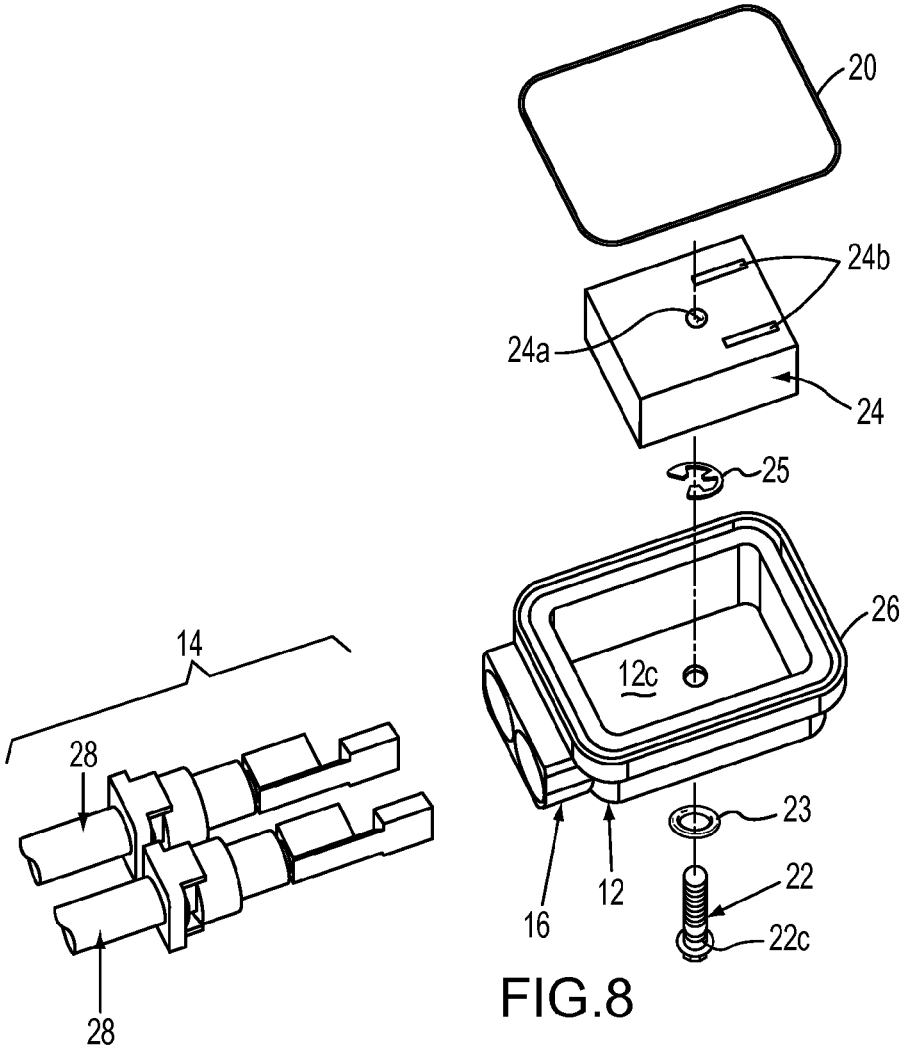
FIG. 8 is another exploded perspective view the first exemplary embodiment of the electrical connector of the present invention.

With reference to FIGS. 3, 7 and 10, the grounding assembly 18 includes a yoke member 36. In FIGS. 5 and 7, the yoke member 36 is a resiliently-biased component, i.e. exhibits spring-like properties, and projects outwardly from the opening 26 (FIG. 5) when the grounding assembly 18 is received and releasably retained in the shield cover cavity 12*c*. The yoke member 36 is fabricated from an electrically-conductive sheet material such as copper, steel or aluminum. For the first exemplary embodiment of the electrical connector 10 of the present invention, the grounding assembly 18 includes a grounding bar member 38 that is fabricated from an electrically-conductive material and a pair of grounding assembly fasteners 40 such as conventional screws. The grounding bar member 38 has a pair of grounding bar member holes 38*a* that extend therethrough. The grounding bar member 38 has a flat surface 38*b* and an opposite scalloped surface 38*c* The pair of grounding bar member holes 38*a* extend through and between the flat surface 38*b* and the scalloped surface 38*c*. The yoke member 36 has a pair of leg portions 36*a* and a contact portion 36*b* that interconnects the pair of leg portions 36*a* Each leg portion 36*a* has a leg portion hole 36*c* that is formed therethrough. As best shown in FIG. 7, the contact portion 36*b* includes a pair of outwardly-projecting U-shaped sections 36*b*1 that are interconnected by an inwardly-projecting U-shaped section 36*b*2. Respective ones of the pair of leg portions 36*a* are connected to respective ones of the outwardly-projecting U-shaped sections and extend outwardly therefrom.

As best shown in FIG. 3, a grounding assembly mounting block 42 is disposed in the shield cover cavity 12*c*. By way of example only and not by way of limitation, the grounding assembly mounting block 42 is integrally connected to the base panel 12*a* of the shield cover 12. The grounding assembly mounting block 42 has a pair of threaded grounding assembly mounting block holes 42*a* disposed apart from one another. As would be understood by one of ordinary skill in the art, the grounding assembly mounting block 42 and the grounding bar member 38 are associated with one another in a manner that respective ones of the pair of grounding bar member holes 38*a*, the pair of threaded grounding assembly mounting block holes 42*a* and the leg portion holes 36*c* register with one another in order to receive the respective ones of the grounding assembly fasteners 40 for releasably connecting the grounding assembly 18 and the shield cover 12 to each other and, further, to clamp the exposed wire shielding portion 28*c*1*a* between the yoke member 36 and the grounding assembly mounting block 42 as reflected in FIGS. 10 and 11.

When the grounding assembly 18 and the shield cover 12 are releasably connected to each other, at least portions of the outwardly-projecting U-shaped sections 36*b*1 project outwardly from the opening as shown in FIG. 5 while the inwardly-projecting U-shaped section 36*b*2 and the pair of leg portions 36*a* are disposed interiorly of the shield cover cavity 12*c* as shown in FIG. 7. As best shown in FIG. 3, note that the grounding assembly mounting block 42 is disposed adjacent the side wall 12*b*1.

In FIGS. 1-5 and 7, the peripheral side wall edge portion 12*bp* includes an inner peripheral side wall 12*bp*1 and an outer peripheral side wall 12*bp*2 that extend circumferentially about the shield cover 12. However, as skilled artisan would appreciate that the outer peripheral side wall 12*bp*2 might extend only partially about the shield cover 12 without departing from the spirit of the invention. The outer peripheral side wall 12*bp*2 is connected to and is disposed apart and outwardly from the inner peripheral side wall 12*bp*1 and extends toward the opening 26 to define a channel 44 therebetween. The outer peripheral side wall 12*bp*2 extends along and about the fours side walls 12*b*1-12*b*4 and is disposed apart from the opening 26. In other words, the outer peripheral side wall 12*bp*2 is shorter than the inner peripheral side wall 12*bp*1.

As best shown in FIGS. 5 and 7, the inner peripheral side wall 12*bp*1 has a circumferential groove 46 formed therein. The circumferential groove 46 faces away from the shield cover cavity 12*c*. Further, the shield cover seal 20, preferably in a form of an O-ring seal, is sized and adapted to be received at least partially within the circumferential groove 46 as best shown in FIG. 7. Although not by way of limitation but by example only, the circumferential groove 46 is disposed between the channel 44 and the opening 26.

As best shown in FIGS. 3 and 6, the back cover 30 includes back cover main panel 30*a* that has a cable-receiving hole 30*a*1 formed therethrough and a pair of latch panels 30*b*. The pair of latch panels 30*b* are facially disposed apart from and extend parallel to one another. Also, the pair of latch panels 30*b* are connected perpendicularly to the back cover main panel 30*a* in a cantilevered manner. Each latch panel 30*b* has a latch panel hole 30*b*1 formed therethrough. As known by one of ordinary skill in the art, each latch panel 30*b* is operative to move to and between a normal state (solid lines in FIG. 6) and a flexed state (dashed lines in FIG. 6). Furthermore, each latch panel 30*b* is resiliently biased to the normal state.

With reference to FIG. 3, the back cover 30 also includes a hollow collar 30*c* that defines a collar passageway 30*c*1. The collar 30*c* is connected to the back cover main panel 30*a* and is disposed between the pair of latch panels 30*b*. The collar passageway 30*c*1 and the cable-receiving hole 30*a*1 are axially aligned and are in communication with one another.

Again, with reference to FIGS. 1-3 and 5, the conduit 16 has a pair of opposing exterior flat surfaces 16*b*. Also, for the first exemplary embodiment of the invention, the conduit 16 also has a first pair of opposing latch projections 16*c*1*a* and 16*c*1*b* and a second pair of opposing latch projections 16*c*2*a* and 16*c*2*b*. However, a skilled artisan would appreciate that at least one pair of opposing latch projections can be implemented to practice the invention. For each pair of opposing latch projections, one latch projection 16*c*1*a* and 16*c*2*a* projects from one exterior flat surface 16*b* and a remaining one of the pair of latch projections 16*c*1*b* and 16*c*2*b* project from a remaining one of the exterior flat surfaces 16*b*. As is known in the art, respective ones of the latch panel holes 30*b*1 are sized to capture respective ones of the latch projections 16*c*1*a*, 16*c*1*b*, 16*c*2*a* and 16*c*2*b* when the cable assemblies 14 are releasably connected to the conduit 16.

As best shown in FIG. 6, the cable assembly terminal 34 is a female blade-receiving terminal that has a connection piece 34*a* and a U-shaped piece 34*b*. The U-shaped piece 34*b* is integrally connected to the connection piece 34*a*. The connection piece 34*a* is connected to the exposed conducting wire portion 28*a*1.

A second exemplary embodiment of an electrical connector 210 of the present invention is introduced in FIGS. 12-16. The second exemplary embodiment of the electrical connector 210 of the present invention is similar to the first exemplary embodiment of the electrical connector 10 described above. Therefore, no further explanation is provided where the first exemplary embodiment and the second exemplary embodiment share common reference numbers. However, the different features are discussed hereinbelow.

Figure 14:
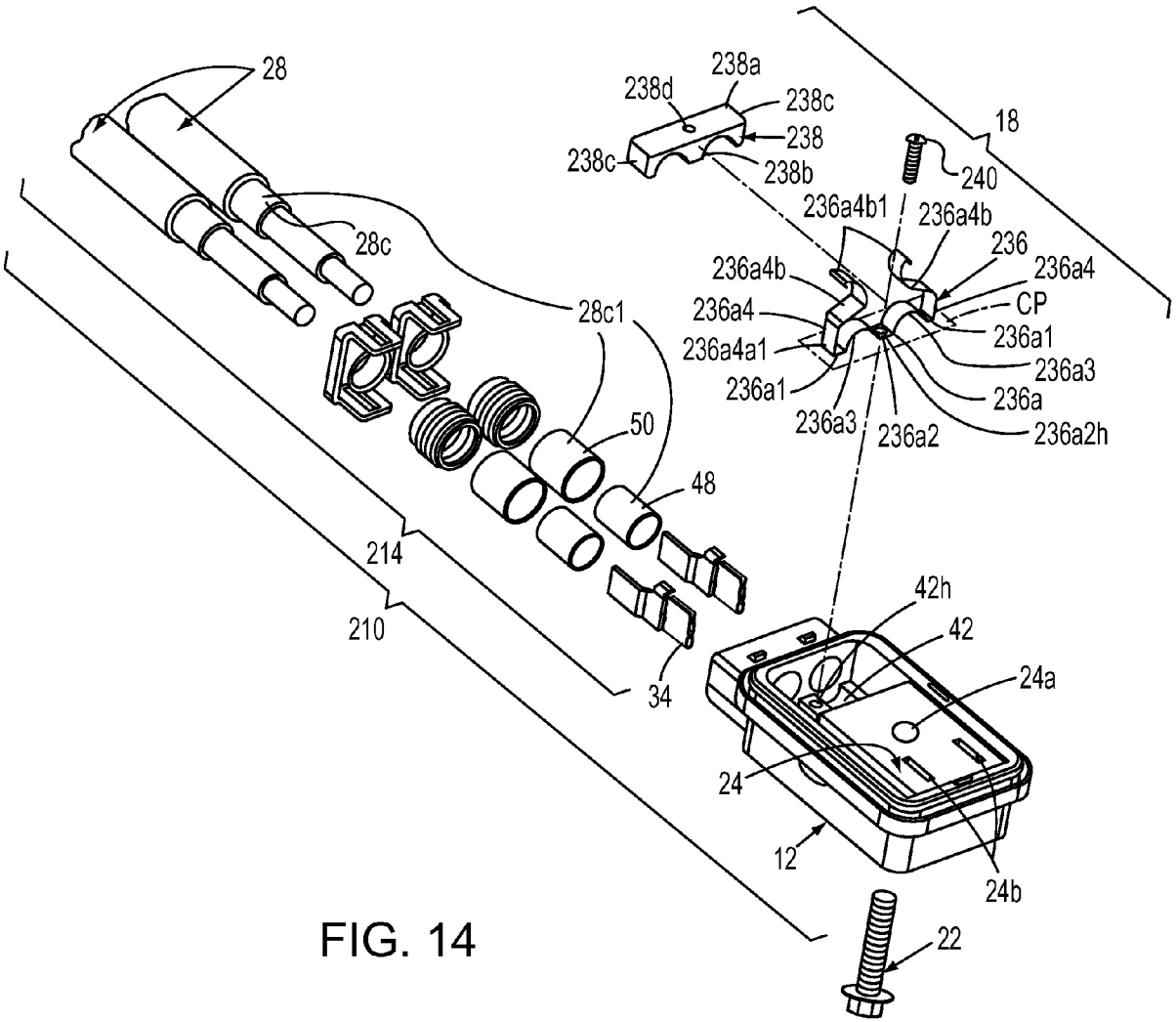
FIG. 14 is an exploded perspective view the another exemplary embodiment of the electrical connector of the present invention.
Figure 15:
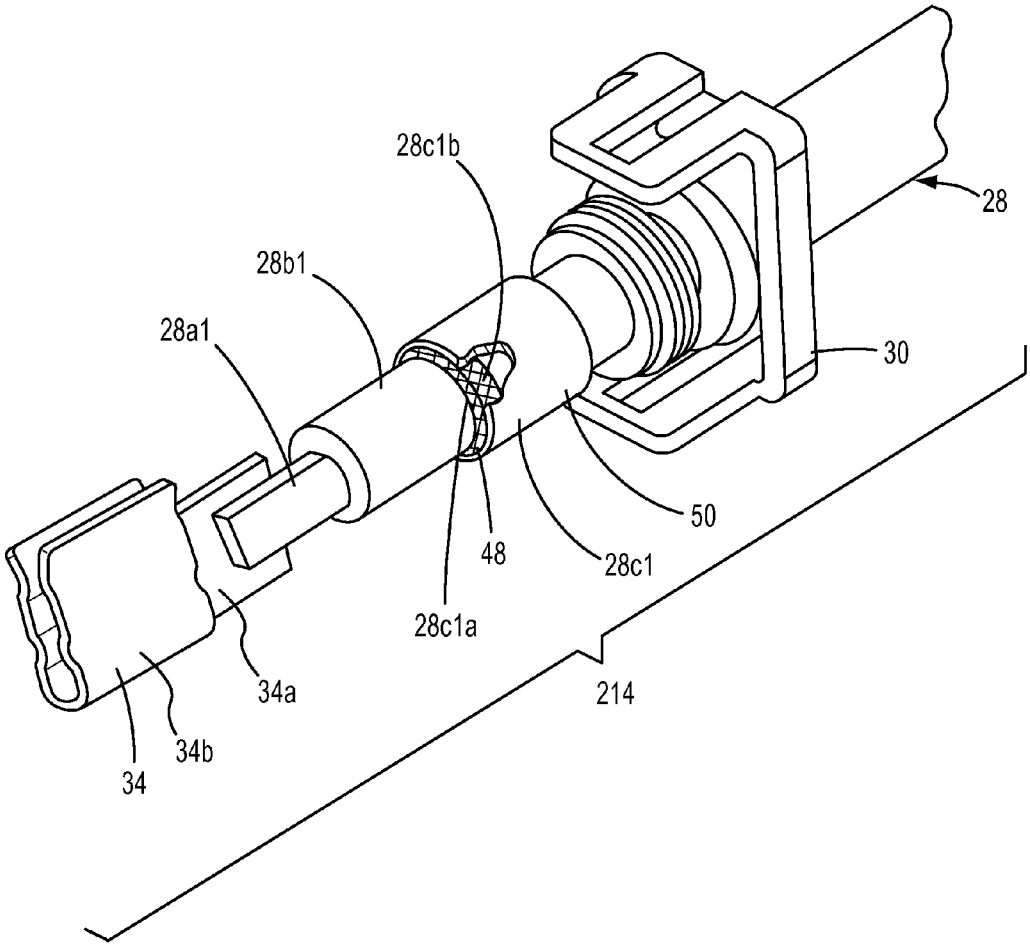
FIG. 15 is an enlarged perspective view of a cable assembly as a component of the another exemplary embodiment of the electrical connector of the present invention.

As best shown in FIGS. 14 and 15, a different cable assembly 214 is hereinafter described. In FIG. 15, the exposed wire shielding arrangement 28*c*1 includes the exposed wire shielding portion 28*c*1*a* and a folded-back exposed wire shielding portion 28*c*1*b* that is electrically and mechanically connected to the exposed wire shielding portion 28*c*1*a*. Also, the cable assembly 214 includes an inner ferrule 48 and an outer ferrule 50. The inner ferrule 48 is connected to, is in contact with and surrounds the exposed wire shielding portion 28*c*1*a*. The folded-back exposed wire shielding portion 28*c*1*b* is the same exposed wire shielding portion 28*c*1*a* except that a section of the exposed wire shielding portion 28*c*1*a*, i.e., the folded-back exposed wire shielding portion 28*c*1*b*, is folded back over the inner ferrule 48 in order to be in surrounding contact with the inner ferrule 48. The outer ferrule 50 is connected to, is in contact with and surrounds the folded-back exposed wire shielding portion 28*c*1*b*, thus yielding the exposed wire shielding arrangement 28*c*1 for the second exemplary embodiment of the electrical connector 210. Thus, the exposed wire shielding arrangement 28*c*1 of the second exemplary embodiment of the electrical connector 210 is clamped between the yoke member 30 and the grounding assembly mounting block 42.

In FIG. 14, the second exemplary embodiment of the electrical connector 210 also has a yoke member 236 that has a yoke member base 236*a* having two flat end pieces 236*a*1, a center piece 236*a*2 and two arcuate pieces 236*a*3. Each arcuate piece 236*a*3 is integrally formed with a respective flat end piece 236*a*1 and the center piece 236*a*2 and a pair of yoke member arm portions 236*a*4. Each of the yoke member arm portions 236*a*4 has a straight piece 236*a*4*a* and a curved piece 236*a*4*b*. Each respective straight piece 236*a*4*a* integrally interconnects a respective one of the curved pieces 236*a*4*b* and the flat end pieces 236*a*1. The center piece 236*a*2 has a center piece hole 236*a*2*h* that is formed therethrough. The two flat end pieces 236*a*1 and the center piece 236*a*2 are disposed in a common plane CP and the two straight pieces 236*a*4*a* extend perpendicularly to the common plane CP. Respective ones of the two curved pieces 236*a*4*b* extend from respective ones of the straight pieces 236*a*4*a* towards each other and away from the common plane CP and reverse away from one other prior to contacting one another in order to terminate and form hook-shaped contact portions 236*a*4*b*1.

Figure 16:
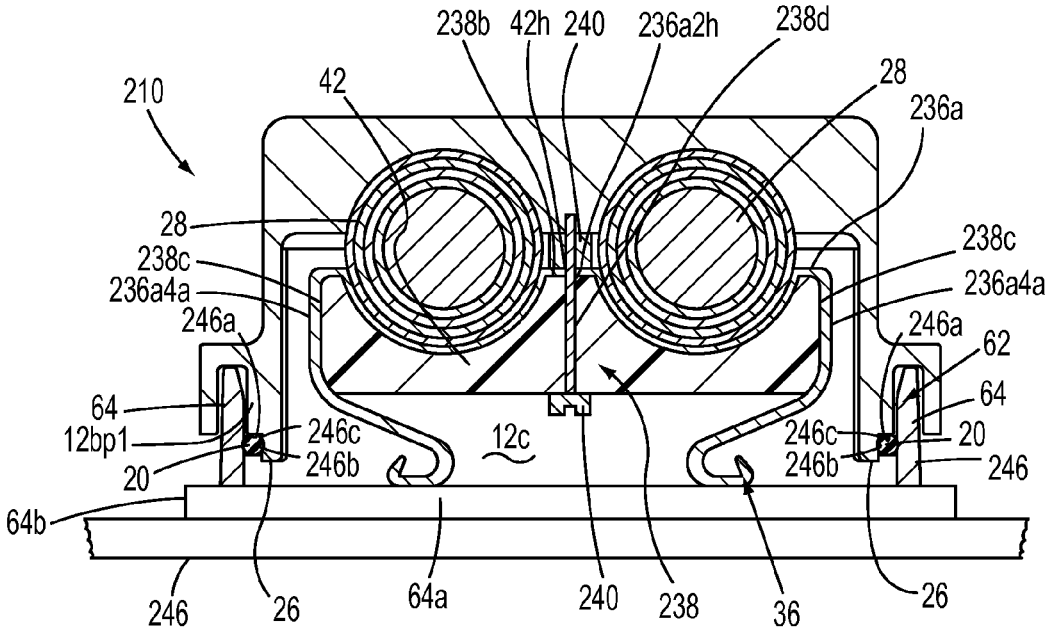
FIG. 16 is a cross-sectional view of the another exemplary embodiment of the electrical connector of the present invention taken along line 16-16-16 in FIG. 13.

Also, in FIGS. 14 and 16, the grounding assembly 18 includes a grounding bar member 238 and a grounding assembly fastener 240. The grounding bar member 238 has a flat surface 238*a*, an opposite scalloped surface 238*b* and a pair of opposite flat side surfaces 238*c* that interconnect the flat surface 238*a* and the scalloped surface 238*b*. The grounding bar member 238 has a centrally-disposed grounding bar member hole 238*d* that extends through and between the flat surface 238*a* and the scalloped surface 238*b*.

In FIG. 16, respective ones of the flat side surfaces 238*c* and respective ones of the straight pieces 236*a*4*a* facially contact each other. The scalloped surface 238*b* and the yoke member base 236*a* facially contact one another. The grounding bar member hole 238*d* and the center piece hole 236*a*2*h* are in registration with one another so that the grounding assembly fastener 240 can be received therein and releasably connect the grounding assembly 18 and the shield cover 12 to each other.

Also, in FIG. 16, the grounding assembly mounting block 42 is similar to the one describe above except that this grounding assembly mounting block includes a single threaded grounding assembly mounting block hole 42*h* that is formed therein. As above, the grounding assembly mounting block 42 and the grounding bar member 238 are associated with one another in a manner that the grounding bar member hole 238*d* and the grounding assembly mounting block hole 42*h* register with one another to receive the grounding assembly fastener 240 for releasably connecting the grounding assembly 18 and the shield cover 12 to each other and to clamp the exposed wire shielding arrangement 28*c*1 between the yoke member 236 and the grounding assembly mounting block 42, thus grounding the electrical connection.

Additionally, as best shown in FIG. 16, the inner peripheral side wall 12*bp*1 has a circumferential notch 246 rather than a circumferential groove 46 implemented in the first exemplary embodiment of the invention. The circumferential notch 246 extends into the inner peripheral side wall 12*bp*1 adjacent the opening 26 and extends circumferentially about the inner peripheral side wall 12*bp*1. The circumferential notch 246 is defined by a first notch surface 246*a* that extends at an exterior of the inner peripheral side wall 12*bp*1 towards the shield cover cavity 12*c* and a second notch surface 246*b* that extends from an inner peripheral side wall edge 246*c* and perpendicularly to the first notch surface 246*a*. Note that the shield cover seal 20 is sized and adapted to be received at least partially within the circumferential notch 246.

Figure 12:
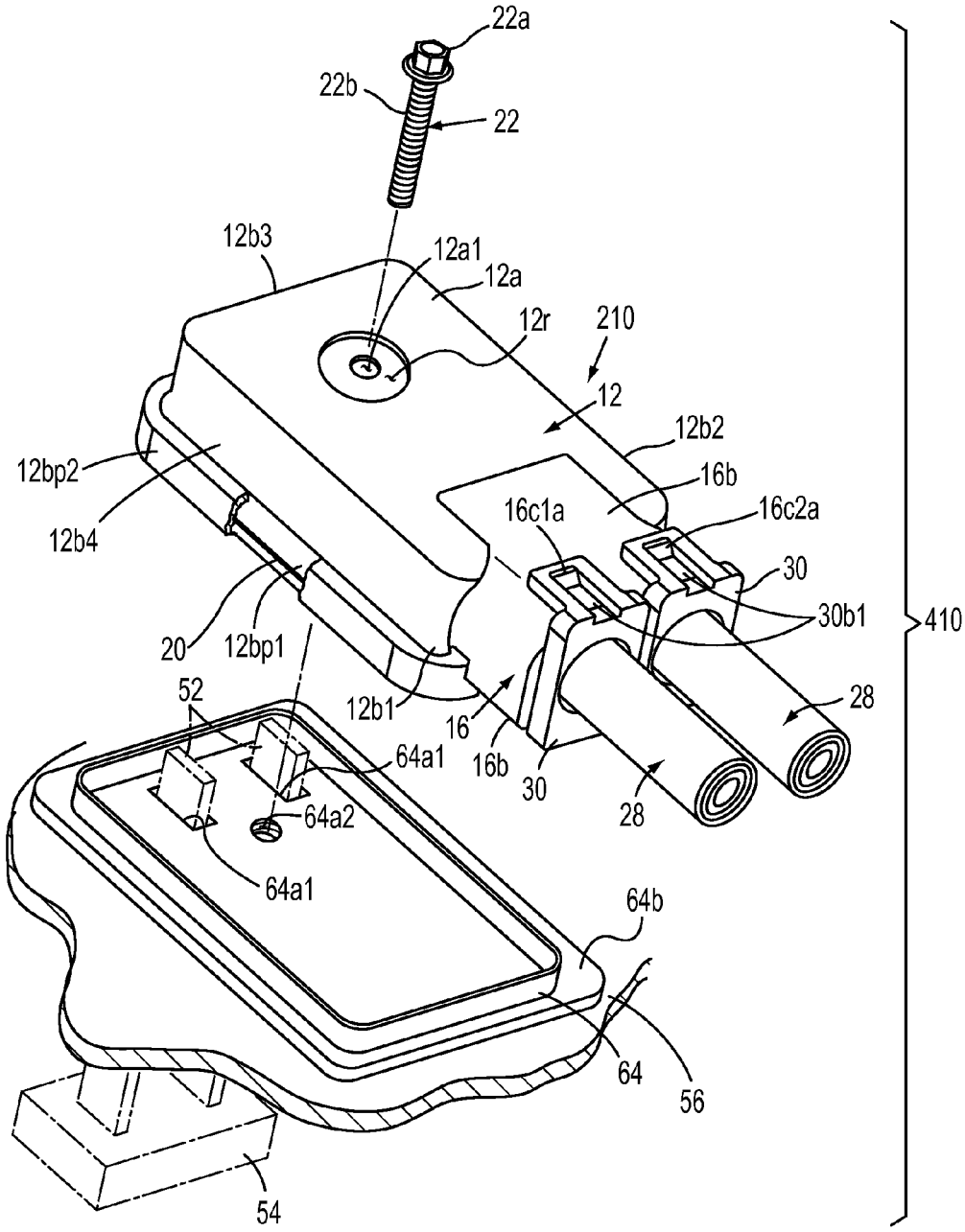
FIG. 12 is a perspective view, partially exploded and partially broken away, of another exemplary embodiment of an electrical connector of the present invention disposed apart and disconnected from the plurality to power supply terminals projecting through the support surface and electrically disconnected to a power supply.

In FIGS. 12 and 14, the shield cover 12 has a shield cover recess 12*r* formed into the base panel 12*a*. The shield cover recess 12*r* concentrically surrounds the base panel hole 12*a*1 and extends into the base panel 12*a* so that the fastener head 22*a* can be positioned at least partially thereinto when the electrical connector 210 is fastened to the support surface 56 by the fastener structure 22.

A third exemplary embodiment of an electrical connector assembly 310 is illustrated in FIG. 1. The electrical connector assembly 310 is adapted to be electrically connected a plurality of power supply terminals of a power supply 54 and mechanically connected to a support surface 56. The support surface 56 is fabricated from an electrically conductive material such as steel and has a support surface fastener hole 58 formed thereinto. A plurality of support surface terminal holes 60 are also formed into the support surface 56 so that the power supply terminals 52 can project through the support surface 56. The electrical connector assembly includes the electrical connector 10 or 210 as described above and a barrier wall structure 62. The barrier wall structure 62 has a barrier wall 64 connected to and projecting from the support surface 56 to define a barrier wall recess 66. The barrier wall 64 extends circumferentially about the plurality of power supply terminals 52, the support surface fastener hole 58 and the plurality of support surface terminal holes 60. The barrier wall 64 is sized and configured to receive therein the peripheral side wall edge portion 12*bp* of the shield cover 12 and the shield cover seal 20 connected thereto as shown in FIG. 2. When the peripheral side wall edge portion 12*bp* and the shield cover seal 20 are received in the barrier wall recess 66, the plurality of power supply terminals 52 and the cable assembly terminals 34 are matably engaged with each other as is known in the art, the shield cover seal 20 is in pressing contact with the barrier wall 64 as shown in FIG. 2 and the fastener structure 20 is aligned for threadable engagement with the support surface fastener hole 58 as best shown in FIG. 1. Note also in FIGS. 2 and 7, the channel 44 is sized to slidably receive the barrier wall 64.

As shown in FIG. 5, the outwardly-projecting U-shaped sections 36*b*1 of the yoke member 36 project outwardly from the shield cover cavity 12*c* beyond the opening 26. The yoke member 36 is fabricated from a resilient, electrically conductive material such as copper or steel. When the fastener structure 20 is advanced into the support surface fastener hole 58, the electrical connector 10 eventually moves towards the support surface 56 yet the outwardly-projecting U-shaped sections 36*b*1 resist such movement by a resisting spring force against the support surface 56. However, the fastener structure 20 in advancing engagement with the support surface fastener hole 58 overcomes the resisting spring force and the outwardly-projecting U-shaped sections 36*b*1 retracts either fully (FIG. 7) or partially (FIG. 16 hereinafter discussed) into the shield cover cavity 12*c* while continuously applying the resisting spring force to the support surface 56. It is this resisting spring force that assures grounding of the electrical connector 10 to the support surface 56 since the yoke member 36 and the exposed wire shielding portion 28*c*1*a* are in either direct or indirect electrical contact with one another.

Figure 13:
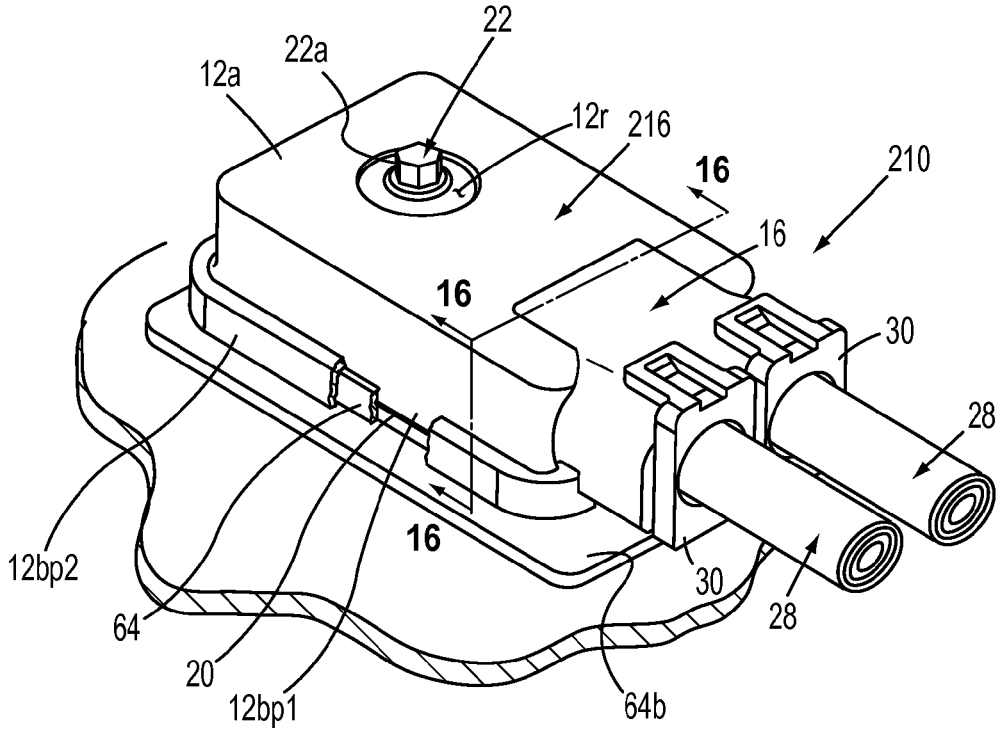
FIG. 13 is a perspective view, partially broken away, of the another exemplary embodiment of the electrical connector of the present invention electrically connected to the power supply.

A fourth exemplary embodiment of an electrical connector assembly 410 is illustrated in FIGS. 12, 13 and 16. The fourth exemplary embodiment of the electrical connector assembly 410 is similar to the third exemplary embodiment of the electrical connector assembly 310 described above. The differences are mentioned below.

Although not by way of limitation but by example only, the fourth exemplary embodiment 410 employs the electrical connector 210 with the circumferential notch 246. Also, note that the barrier wall structure 62 includes a barrier wall inner panel 64*a* connected to the barrier wall 64 and disposed in the barrier wall recess 66 and a barrier wall outer panel 64*b* that is connected to and surrounds the barrier wall 64. The barrier wall inner panel 64*a* has a plurality of inner panel terminal holes 64*a*1 to accommodate the plurality of power supply terminals 52 and an inner panel fastener hole 64*a*2 to accommodate the fastener structure 22. Now, this barrier wall structure 62 can be connected to the support surface 56. As long as the barrier wall inner panel 64*a* and the support surface 56 are electrically conductive and contact one another, grounding of the electrical connector 10 or 210 can be achieved in the manner as discussed above. However, note in FIG. 16 that the shield cover 12 does not contact the barrier wall inner panel 64*a* but the yoke member 38 contacts the barrier wall inner panel 64*a* and applies the resisting spring force thereto to assure grounding of the electrical connector 210.

Figure 17:
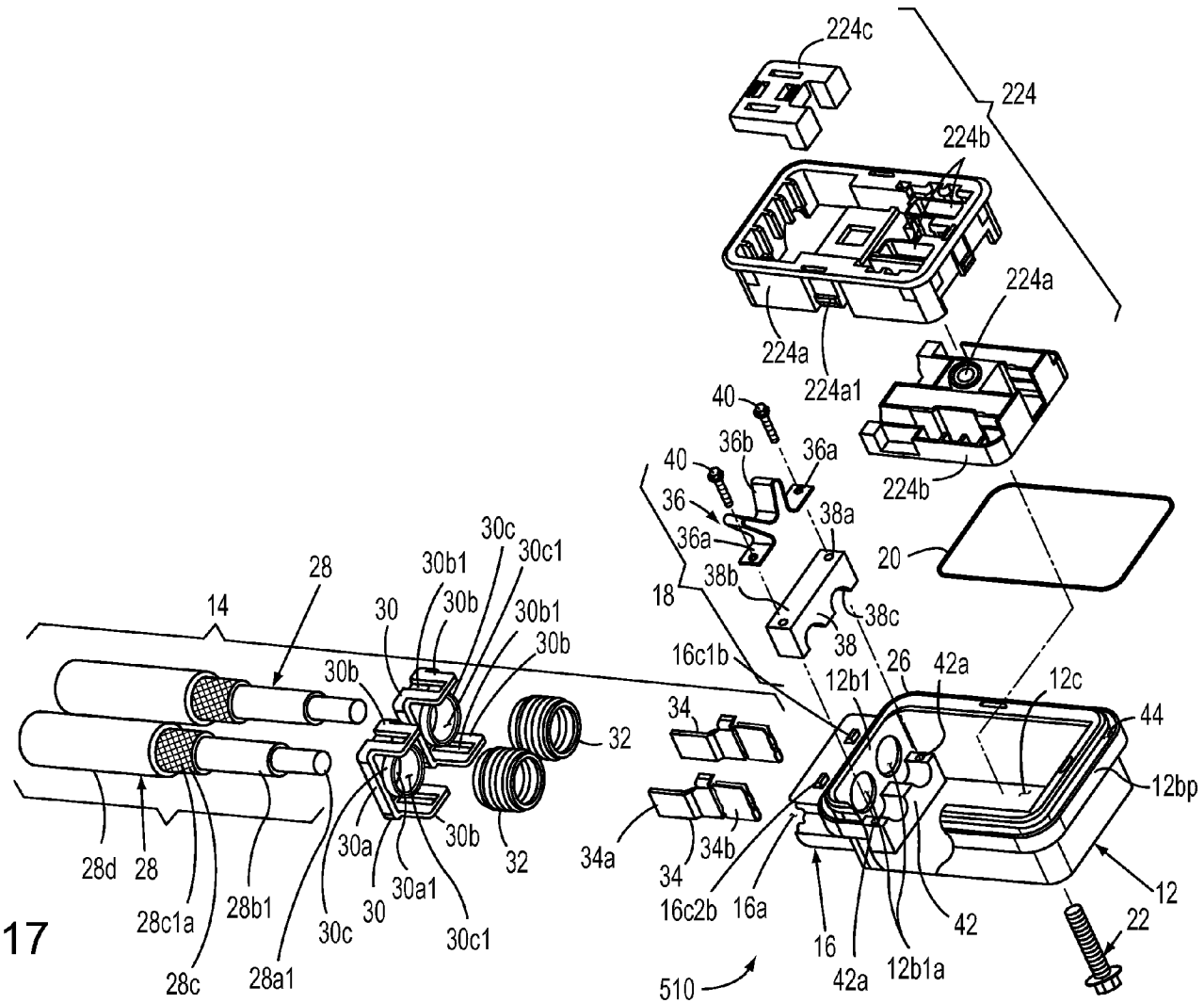
FIG. 17 is an exploded perspective view of still another exemplary embodiment of the electrical connector of the present invention with a three-part exploded terminal mounting block.
Figure 18:
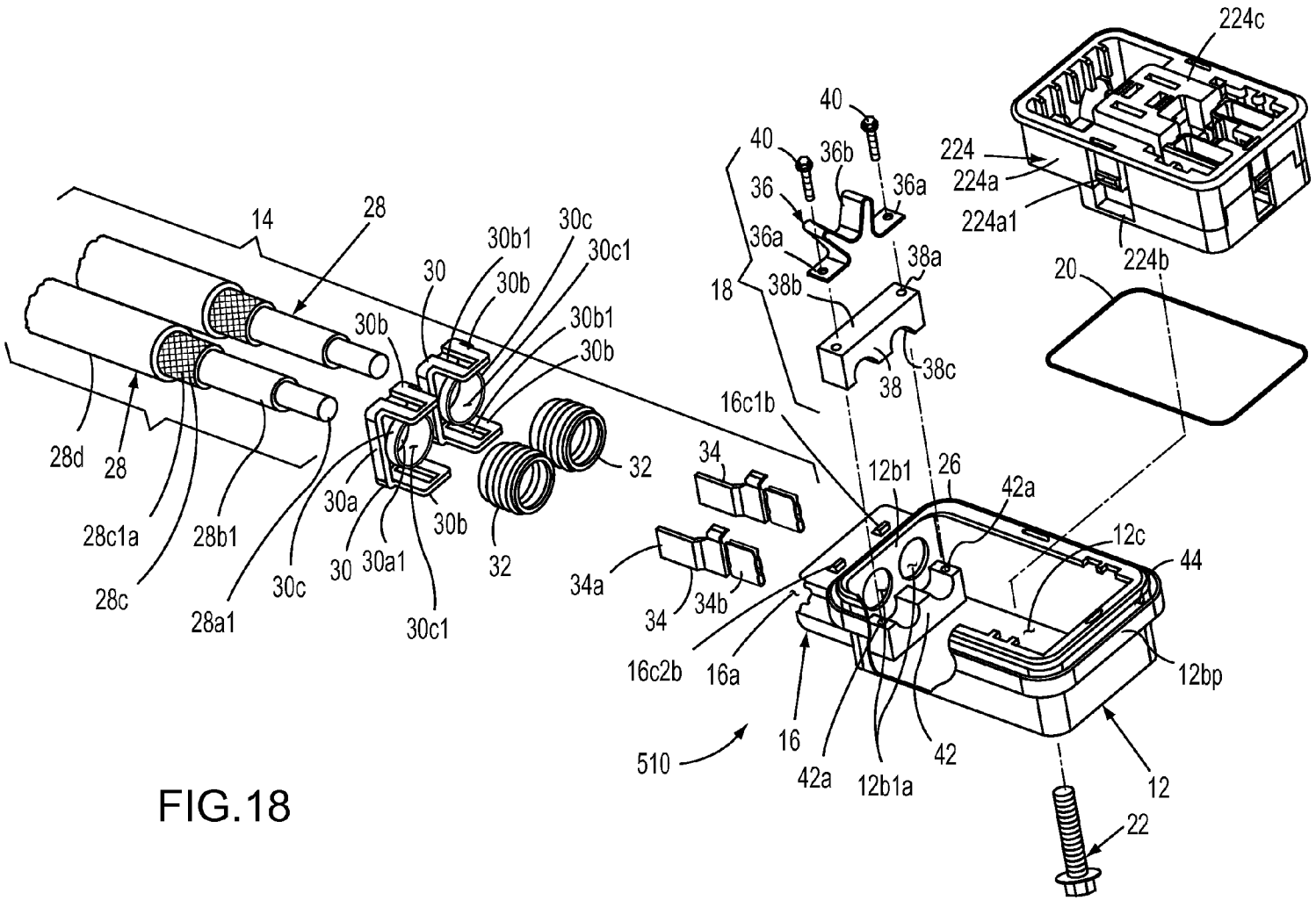
FIG. 18 is an exploded perspective view of the still another exemplary embodiment of the electrical connector shown in FIG. 17 with the three-part terminal mounting block assembled.

A fifth exemplary embodiment of an electrical connector 510 is illustrated in FIGS. 17 and 18. The fifth exemplary embodiment of the electrical connector assembly 510 is similar to the first exemplary embodiment of the electrical connector 10 described above. The differences are mentioned below.

As shown in FIGS. 17 and 18, the electrical connector 510 has a terminal mounting block 224 that includes a first terminal mounting block part 224*a*, a second terminal mounting block part 224*b* and a terminal position assurance part 224*c*. The first terminal mounting block part 224*a* and the second terminal mounting block part 224*b* nest with one another, as best shown in FIG. 18, in a connected manner. Also, the first terminal mounting block part 224*a* releasably receives the terminal position assurance part 224*c*, as shown in FIG. 18. As is commonly known in the art, when the terminal mounting block 224 is assembled, the first terminal mounting block part 224*a* is releasably connected to the shield cover 12 by a pair of flexible latch pieces 224*a*1 (only one is illustrated) to releasably retain the terminal mounting block 224 in the shield cover cavity 12*c*.

One of ordinary skill in the art would appreciate that, when connecting the electrical connector 10 to the support surface 56, a frictional force is generated between the U-shape pieces 34*b* of the cable assembly terminal 34 and the power supply terminals 52 and a resistance force is generated as the yoke member 36 contacts and advances towards the support surface 56. It would be beneficial to place the base panel hole 12*a*1 at a base panel hole location where the combination of the frictional force and the resistance force is counter-acted by a counter-acting force created by the fastener structure 22 in an evenly balanced manner as the fastener structure 22 advances the electrical connector 10 to the support surface 56 as the electrical connector 10 is being fastened thereto. In other words, the base panel hole location should be where a single resultant force of the combination of the friction force and the resistance force acts on the shield cover 12 that resists its connection to the support surface 56. The present invention is intended to provide this base panel hole location.

The exemplary embodiments of the invention described above are particularly useful for high voltage or high current applications. Also, the exemplary embodiments of the invention accept blade-type male terminals. Further, the exemplary embodiments are electrically grounded through the wire shielding. Because of the use of the cable seal and shield cover seal, the exemplary embodiments of the invention are considered waterproof. Also, only one fastener is used to fasten the electrical connector to a support surface. When an electrically-conductive material such as steel is used to fabricate the shield cover, electromagnetic interference effects are reduced.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical connector, comprising:

a shield cover having a base panel and four side walls serially connected to each other and connected to and depending from the base panel to define a shield cover cavity into the shield cover, the base panel having a base panel hole formed therethrough, the connected four side walls defining a peripheral side wall edge portion forming an opening into the shield cover cavity;

at least one cable assembly including a cable, a back cover, a cable seal and a cable assembly terminal, the cable having a conducting wire with an exposed conducting wire portion, an insulating sheath surrounding the conducting wire and having an exposed insulating sheath portion, a wire shielding surrounding the insulating sheath and having an exposed wire shielding arrangement including an exposed wire shielding portion and an outer insulating jacket surrounding the wire shielding, the back cover being in contact with and surrounding the insulating sheath, the cable assembly terminal connected to the exposed conducting wire portion;

a conduit connected to a selected one of the four side walls and forming a conduit passageway therethrough, the conduit passageway being in communication with the shield cover cavity, the conduit sized to receive a portion of the at least one cable assembly therein and therethrough and adapted for the back cover to be releasably connected thereto with the cable seal surrounding the outer insulating jacket and in sealing contact with the conduit and the outer insulating jacket;

a grounding assembly sized to be received and releasably retained in the shield cover cavity between the terminal mounting block and the conduit passageway;

a shield cover seal in contact with and extending about the connected four side walls adjacent the opening;

a fastener structure having a fastener head and an elongated shaft, the elongated shaft sized to be slidably received in the base panel hole; and a terminal mounting block disposed in the shield cover cavity and connected to the shield cover, the terminal mounting block adapted to receive and retain at least the cable assembly terminal and the exposed conducting wire portion therein and to permit the elongated shaft to pass therethrough.

2. An electrical connector according to claim 1, wherein, upon releasably connecting the back cover to the conduit, the cable seal is received and retained in the conduit passageway in a sealing relationship with the conduit and the outer insulating jacket.

3. An electrical connector according to claim 1, wherein the grounding assembly including a yoke member being resiliently-biased and projecting outwardly from the opening when the grounding assembly is received and releasably retained in the shield cover cavity, the yoke member being fabricated from an electrically-conductive sheet material.

4. An electrical connector according to claim 3, wherein the grounding assembly includes a grounding bar member fabricated from an electrically-conductive material and a pair of grounding assembly fasteners, the grounding bar member having a pair of grounding bar member holes extending therethrough, the yoke member having a pair of leg portions and a contact portion interconnecting the pair of leg portions, each leg portion having a leg portion hole formed therethrough.

5. An electrical connector according to claim 4, wherein the contact portion includes a pair of outwardly-projecting U-shaped sections interconnected by an inwardly-projecting U-shaped section, respective ones of the pair of leg portions connected to respective ones of the outwardly-projecting U-shaped sections.

6. An electrical connector according to claim 5, further comprising a grounding assembly mounting block disposed in the shield cover cavity and integrally connected to the base panel, the grounding assembly mounting block having a pair of threaded grounding assembly mounting block holes disposed apart from one another, the grounding assembly mounting block and the grounding bar member associated with one another in a manner that respective ones of the pair of grounding bar member holes, the pair of threaded grounding assembly mounting block holes and the leg portion holes register with one another to receive respective ones of the grounding assembly fasteners for releasably connecting the grounding assembly and the shield cover to each other and to clamp the exposed wire shielding arrangement between the yoke member and the grounding assembly mounting block.

7. An electrical connector according to claim 6, wherein, when the grounding assembly and the shield cover are releasably connected to each other, at least portions of the outwardly-projecting U-shaped sections project outwardly from the opening while the inwardly-projecting U-shaped section and the pair of leg portions are disposed interiorly of the shield cover cavity, the grounding assembly mounting block is disposed adjacent the selected one of the four side walls.

8. An electrical connector according to claim 4, wherein the grounding bar member has a flat surface and an opposite scalloped surface, the pair of grounding bar member holes extending through and between the flat surface and the scalloped surface.

9. An electrical connector according to claim 4, wherein the yoke member has a yoke member base having two flat end pieces, a center piece and two arcuate pieces with each arcuate piece integrally formed with a respective flat end piece and the center piece and a pair of yoke member arm portions, each yoke member arm portion having a straight piece and a curved piece, each respective straight piece integrally interconnecting a respective one of the curved pieces and the flat end pieces, the center piece having a center piece hole formed therethrough.

10. An electrical connector according to claim 9, wherein the two flat end pieces and the center piece are disposed in a common plane and the two straight pieces extending perpendicularly to the common plane.

11. An electrical connector according to claim 10, wherein respective ones of the two curved pieces extend from respective ones of the straight pieces towards each other and away from the common plane and reverse away from one other prior to contacting one another to terminate and form hook-shaped contact portions.

12. An electrical connector according to claim 11, wherein the grounding assembly includes a grounding bar member and a grounding assembly fastener, the grounding bar member has a flat surface, an opposite scalloped surface and a pair of opposite flat side surfaces interconnecting the flat surface and the scalloped surface, the grounding bar member having a centrally-disposed grounding bar member hole extending through and between the flat surface and the scalloped surface, respective ones of the flat side surfaces and respective ones of the straight pieces facially contacting each other and the scalloped surface and the yoke member base facially contacting one another with the grounding bar member hole and the center piece hole being in registration with one another so that the grounding assembly fastener can be received therein and releasably connect the grounding assembly and the shield cover to each other.

13. An electrical connector according to claim 12, further comprising a grounding assembly mounting block disposed in the shield cover cavity and integrally connected to the base panel, the grounding assembly mounting block having a threaded grounding assembly mounting block hole formed therein, the grounding assembly mounting block and the grounding bar member associated with one another in a manner that the grounding bar member hole and the grounding assembly mounting block hole with one another to receive the grounding assembly fastener for releasably connecting the grounding assembly and the shield cover to each other and to clamp the exposed wire shielding arrangement between the yoke member and the grounding assembly mounting block.

14. An electrical connector according to claim 1, wherein the peripheral side wall edge portion includes an inner peripheral side wall extending circumferentially about the shield cover and an outer peripheral side wall extending at least partially circumferentially about the shield cover, the outer peripheral side wall connected to and disposed apart and outwardly from the inner peripheral side wall and extending toward the opening to define a channel therebetween, the outer peripheral side wall extending along and about the fours side walls adjacent the opening.

15. An electrical connector according to claim 14, wherein the inner peripheral side wall has a circumferential groove formed therein, the circumferential groove facing away from the shield cover cavity.

16. An electrical connector according to claim 15, wherein the shield cover seal is sized and adapted to be received at least partially within the circumferential groove.

17. An electrical connector according to claim 15, wherein the circumferential groove is disposed between the channel and the opening.

18. An electrical connector according to claim 15, wherein the inner peripheral side wall has a circumferential notch extending into the inner peripheral side wall adjacent the opening and extending circumferentially about the inner peripheral side wall, the circumferential notch being defined by a first notch surface extending at an exterior of the inner peripheral side wall towards the shield cover cavity and a second notch surface extending from an inner peripheral side wall edge and perpendicularly to the first notch surface.

19. An electrical connector according to claim 18, wherein the shield cover seal is sized and adapted to be received at least partially within the circumferential notch.

20. An electrical connector according to claim 1, wherein the back cover includes back cover main panel having a cable-receiving hole formed therethrough and a pair of latch panels facially disposed apart from and extending parallel to one another and connected perpendicularly to the back cover main panel in a cantilevered manner, each latch panel having a latch panel hole formed therethrough and operative to move to and between a normal state and a flexed state, each latch panel being resiliently biased to the normal state.

21. An electrical connector according to claim 20, wherein the back cover includes a hollow collar defining a collar passageway, the collar connected to the back cover main panel and disposed between the pair of latch panels, the collar passageway and the cable-receiving hole being axially aligned and in communication with one another.

22. An electrical connector according to claim 21, wherein the conduit has a pair of opposing exterior flat surfaces and at least one opposing pair of latch projections with one latch projection projecting from one exterior flat surface and a remaining one of the pair of latch projections projecting from a remaining one of the exterior flat surfaces, respective ones of the latch panel holes sized to capture respective ones of the latch projections when the at least one cable assembly is connected to the conduit.

23. An electrical connector according to claim 1, wherein the cable assembly terminal is a female blade-receiving terminal having a connection piece and a U-shaped piece integrally connected to the connection piece, the connection piece connected to the exposed conducting wire portion.

24. An electrical connector according to claim 1, the at least one cable assembly includes an inner ferrule connected to, in contact with and surrounding the exposed wire shielding portion.

25. An electrical connector according to claim 1, wherein the exposed wire shielding arrangement includes a folded-back exposed wire shielding portion electrically and mechanically connected to the exposed wire shielding portion and wherein the at least one cable assembly includes an inner ferrule and an outer ferrule such that the inner ferrule is connected to, in contact with and surrounds the exposed wire shielding portion, the folded-back exposed wire shielding portion is folded back over the inner ferrule to be in surrounding contact with the inner ferrule and the outer ferrule is connected to, in contact with and surrounds the folded-back exposed wire shielding portion.

26. An electrical connector according to claim 1, wherein the terminal mounting block includes a terminal mounting block hole formed therethrough and sized to slidably receive the elongated shaft.

27. An electrical connector according to claim 26, wherein the terminal mounting block includes a first terminal mounting block part, a second terminal mounting block part and a terminal position assurance part, the first terminal mounting block part and the second terminal mounting block part nest with one another, the first terminal mounting block part releasably receives the terminal position assurance part and is releasably connected to the shield cover.

28. An electrical connector assembly adapted to be electrically connected a plurality of power supply terminals of a power supply and mechanically connected to a support surface having a fastener hole formed thereinto and a plurality of terminal holes formed thereinto with the power supply terminals projecting therethrough, the electrical connector assembly comprising:

an electrical connector including:

a shield cover having a base panel and four side walls serially connected to each other and connected to and depending from the base panel to define a shield cover cavity into the shield cover, the base panel having a base panel hole formed therethrough, the connected four side walls defining a peripheral side wall edge portion forming an opening into the shield cover cavity;

a shield cover seal extending circumferentially around and in contact with the peripheral side wall edge portion exteriorly of the shield cover cavity;

a plurality of cable assemblies, each cable assembly including a cable, a back cover, a cable seal and a cable assembly terminal, the cable having a conducting wire with an exposed conducting wire portion, an insulating sheath surrounding the conducting wire and having an exposed insulating sheath portion, a wire shielding surrounding the insulating sheath and having an exposed wire shielding arrangement including an exposed wire shielding portion and an outer insulating jacket surrounding the insulating sheath behind the exposed wire shielding portion, the back cover being in contact with and surrounding the insulating sheath, the cable assembly terminal connected to the exposed conducting wire portion;

a conduit connected to a selected one of the four side walls and forming a conduit passageway therethrough, the conduit passageway being in communication with the shield cover cavity, the conduit sized to receive a portion of the at least one cable assembly therein and therethrough and adapted for the back cover to be releasably connected thereto with the cable seal surrounding the outer insulating jacket and in sealing contact with the conduit and the outer insulating jacket;

a grounding assembly sized to be received and releasably retained in the shield cover cavity between the terminal mounting block and the conduit passageway;

a shield cover seal in contact with and extending about the connected four side walls adjacent the opening;

a fastener structure having a fastener head and an elongated shaft, the elongated shaft sized to be slidably received in the base panel hole; and a terminal mounting block disposed in and connected to the shield cover, the terminal mounting block adapted to receive and retain at least the cable assembly terminal and the exposed conducting wire portion therein and to permit the elongated shaft to pass therethrough, and a barrier wall structure having a barrier wall connected to and projecting from the support surface to define a barrier wall recess, the barrier wall extending circumferentially about the plurality of power supply terminals, the support surface fastener hole and the plurality of support surface terminal holes and configured to receive therein the peripheral side wall edge portion of the shield cover along with the shield cover seal, wherein, when the peripheral side wall edge portion and the shield cover seal are received in the barrier wall recess, the plurality of power supply terminals and the cable assembly terminals are matably engaged with each other, the shield cover seal is in pressing contact with the barrier wall and the fastener structure is aligned for threadable engagement with the support surface fastener hole.

29. An electrical connector assembly according to claim 28, wherein the peripheral side wall edge portion includes an inner peripheral side wall extending circumferentially about the shield cover and an outer peripheral side wall connected to and disposed apart and outwardly from the inner peripheral side wall and extending toward the opening to define a channel therebetween, the outer peripheral side wall extending along and about the fours side walls adjacent the opening and disposed apart from the opening, the channel sized to slidably receive the barrier wall.

30. An electrical connector assembly according to claim 29, wherein the inner peripheral side wall has a circumferential groove formed therein, the circumferential groove facing away from the shield cover cavity, the shield cover seal sized and adapted to be received at least partially within the circumferential groove.

31. An electrical connector assembly according to claim 30, wherein the circumferential groove is disposed between the channel and the opening.

32. An electrical connector assembly according to claim 29, wherein the inner peripheral side wall has a circumferential notch extending into the inner peripheral side adjacent the opening and extending circumferentially about the inner peripheral side wall, the circumferential notch being defined by a first notch surface extending at an exterior of the inner peripheral side wall towards the shield cover opening and a second notch surface extending from an inner peripheral side wall edge and perpendicularly to the first notch surface, the shield cover seal sized and adapted to be received at least partially within the circumferential notch.

33. An electrical connector assembly according to claim 28, wherein, upon releasably connecting the back cover to the conduit, the cable seal is received and retained in the conduit passageway in a sealing relationship with the conduit and the outer insulating jacket.

34. An electrical connector assembly according to claim 29, wherein the barrier wall structure includes a barrier wall inner panel connected to the barrier wall and disposed in the barrier wall recess and a barrier wall outer panel connected to and surrounding the barrier wall.

* * * * *